US010677413B2

(12) United States Patent
Shibata et al.

(10) Patent No.: US 10,677,413 B2
(45) Date of Patent: Jun. 9, 2020

(54) LIGHTING DEVICE HAVING AN LED, THERMISTOR AND RESISTOR CONNECTED IN SERIES WITH A HEAT CONDUCTION SUPPRESSOR CONFIGURED TO SUPPRESS HEAT TO THE THERMISTOR

(71) Applicant: KOITO MANUFACTURING CO., LTD., Tokyo (JP)

(72) Inventors: Hiroki Shibata, Shizuoka (JP); Kunio Fujita, Shizuoka (JP); Masaya Fujiwara, Shizuoka (JP); Ryo Iwaki, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/486,263

(22) PCT Filed: Feb. 15, 2018

(86) PCT No.: PCT/JP2018/005182
§ 371 (c)(1),
(2) Date: Aug. 15, 2019

(87) PCT Pub. No.: WO2018/151192
PCT Pub. Date: Aug. 23, 2018

(65) Prior Publication Data

US 2019/0376662 A1 Dec. 12, 2019

(30) Foreign Application Priority Data

Feb. 17, 2017 (JP) ..... 2017-027634

(51) Int. Cl.
*F21S 45/40* (2018.01)
*F21V 29/10* (2015.01)
(Continued)

(52) U.S. Cl.
CPC ..... *F21S 45/40* (2018.01); *F21V 29/10* (2015.01); *F21S 41/30* (2018.01); *F21Y 2115/10* (2016.08)

(58) Field of Classification Search
CPC ..... F21Y 2115/10; F21S 45/40
See application file for complete search history.

(56) References Cited

U.S. PATENT DOCUMENTS 10,327,304 B2 * 6/2019 Kosugi ..... H05B 45/50
2017/0009953 A1 1/2017 Kosugi et al.

FOREIGN PATENT DOCUMENTS

JP 2006-12622 A 1/2006
JP 2015-215973 A 12/2015
(Continued)

OTHER PUBLICATIONS

International Search Report dated Apr. 3, 2018 issued by the International Searching Authority in counterpart International Application No. PCT/JP2018/005182 (PCT/ISA/210).
(Continued)

*Primary Examiner* — Robert J May
(74) *Attorney, Agent, or Firm* — Sughrue Mion, PLLC

(57) ABSTRACT

In a lighting device adapted to be mounted on a vehicle, a PTC (positive temperature coefficient) thermistor (535), a first fixed resistor (R1), and a first light emitting element (531) are connected in series with a voltage source. A heat conduction suppressor (7) is configured to suppress heat conduction from the first fixed resistor (R1) to the PTC thermistor (535).

12 Claims, 9 Drawing Sheets

(51) Int. Cl.
*F21Y 115/10* (2016.01)
*F21S 41/30* (2018.01)

(56) References Cited

FOREIGN PATENT DOCUMENTS

| | | | |
|---|---|---|---|
| JP | 2016-105372 | A | 6/2016 |
| JP | 2017-21988 | A | 1/2017 |

OTHER PUBLICATIONS

Written Opinion dated Apr. 3, 2018 issued by the International Searching Authority in counterpart International Application No. PCT/JP2018/005182 (PCT/ISA/237).

* cited by examiner

LIGHTING DEVICE HAVING AN LED, THERMISTOR AND RESISTOR CONNECTED IN SERIES WITH A HEAT CONDUCTION SUPPRESSOR CONFIGURED TO SUPPRESS HEAT TO THE THERMISTOR

TECHNICAL FIELD

The presently disclosed subject matter relates to a lighting device adapted to be mounted on a vehicle.

BACKGROUND ART

In this type of lighting device described in Patent Document 1, a semiconductor light emitting device such as a light emitting diode (LED) is used as a light source.

PRIOR ART DOCUMENT

Patent Document

Patent Document 1: Japanese Patent Publication No. 2016-105372A

SUMMARY

Technical Problem

An object of the presently disclosed subject matter is to obtain illumination light having an appropriate amount of light in an lighting device using a semiconductor light emitting device as a light source.

Solution to Problem

In order to achieve the above object, according to one aspect of the presently disclosed subject matter, there is provided a lighting device adapted to be mounted on a vehicle, comprising:

a semiconductor light emitting device, at least one first PTC (positive temperature coefficient) thermistor, and a first fixed resistor that are connected in series with a voltage source;

a first substrate supporting the first PTC thermistor; and a heat conduction suppressor configured to suppress heat conduction from at least one of the semiconductor light emitting device and the first fixed resistor to the first PTC thermistor.

In order to obtain an appropriate amount of illumination light, it is necessary to accurately grasp an ambient temperature of the semiconductor light emitting element through the PTC thermistor. However, the inventors related to the presently disclosed subject matter have found the following facts. Heat generated from circuit elements such as a fixed resistor and a semiconductor light emitting element included in a light source driving circuit travels through the substrate to the PTC thermistor. This heat causes the element temperature of the PTC thermistor to rise, so that an inherent correspondence between the element temperature and the ambient temperature cannot be maintained. As a result, the PTC thermistor cannot accurately grasp the ambient temperature of the semiconductor light emitting device.

According to the above-described configuration, it is possible to suppress an increase in the element temperature of the first PTC thermistor caused by heat generation of other circuit elements. This allows the correspondence between the element temperature and the ambient temperature to be brought closer to the intended one. Accordingly, the accuracy of the control of the current flowing to the semiconductor light emitting element based on the element temperature of the first PTC thermistor is improved. As a result, in a lighting device using a semiconductor light emitting element as a light source, an appropriate amount of illumination light can be obtained.

The above lighting device may be configured such that:

the first substrate supports the first fixed resistor; and the heat conduction suppressor includes a first slit formed in the first substrate and on a heat conduction path from at least one of the first fixed resistor and the semiconductor light emitting device to the first PTC thermistor.

Heat generated from at least one of the first fixed resistor and the semiconductor light emitting device travels through the first substrate toward the first PTC thermistor. According to the above configuration, since the first slit is formed on the heat conduction path, heat conduction from at least one of the first fixed resistor and the semiconductor light emitting element to the first PTC thermistor can be suppressed.

In other words, it is possible to suppress an increase in the element temperature of the first PTC thermistor caused by heat generation of at least one of the first fixed resistor and the semiconductor light emitting element. Accordingly, the correspondence between the element temperature of the first PTC thermistor and the ambient temperature detected by the first PTC thermistor is made close to the intended one. As a result, the accuracy of the control of the current flowing through the semiconductor light emitting element based on the element temperature of the first PTC thermistor is improved.

In the above configuration, a simple method of forming the first slit is employed instead of providing a special current control circuit in order to obtain the accuracy of the control. Therefore, an appropriate amount of illumination light can be obtained while suppressing an increase in the product cost of the lighting device.

The above lighting device may be configured such that:

the first substrate supports the first fixed resistor;

a first conductive pattern electrically connecting at least one of the first fixed resistor, the semiconductor light emitting device, and the first PTC thermistor is formed on the first substrate; and the heat conduction suppressor includes a portion in which a width of the first conductive pattern is narrowed.

Heat generated from at least one of the first fixed resistor and the semiconductor light emitting device travels through the first conductive pattern toward the first PTC thermistor. According to the configuration described above, since the width of a portion of the first conductive pattern located on such a heat conduction path is narrowed, heat conduction from at least one of the first fixed resistor and the semiconductor light emitting element to the first PTC thermistor can be suppressed.

In other words, it is possible to suppress an increase in the element temperature of the first PTC thermistor caused by heat generation of at least one of the first fixed resistor and the semiconductor light emitting element. Accordingly, the correspondence between the element temperature of the first PTC thermistor and the ambient temperature detected by the first PTC thermistor is made close to the intended one. As a result, the accuracy of the control of the current flowing through the semiconductor light emitting element based on the element temperature of the first PTC thermistor is improved.

In the above configuration, a simple method of narrowing the width of a portion of the first conductive pattern is employed instead of providing a special current control circuit in order to obtain the accuracy of the control. Therefore, an appropriate amount of illumination light can be obtained while suppressing an increase in the product cost of the lighting device.

The above lighting device may be configured such that:

the first substrate supports the first fixed resistor;

a first conductive pattern electrically connecting at least one of the first fixed resistor, the semiconductor light emitting device, and the first PTC thermistor is formed on a first principal surface of the first substrate; and the heat conduction suppressor includes a first through hole electrically connecting the first conductive pattern and a conductive pattern formed on a second principal surface of the first substrate.

Heat generated from at least one of the first fixed resistor and the semiconductor light emitting device travels through the first conductive pattern toward the first PTC thermistor. According to the above configuration, such heat is dissipated to the conductive pattern formed on the second principal surface of the first substrate through the first through hole. As a result, heat conduction from at least one of the first fixed resistor and the semiconductor light emitting element to the first PTC thermistor can be suppressed. The first through hole may also have a function of dissipating heat generated from the first PTC thermistor.

In other words, it is possible to suppress an increase in the element temperature of the first PTC thermistor. Accordingly, the correspondence between the element temperature of the first PTC thermistor and the ambient temperature detected by the first PTC thermistor is made close to the intended one. As a result, the accuracy of the control of the current flowing through the semiconductor light emitting element based on the element temperature of the first PTC thermistor is improved.

In the above configuration, a simple method of forming a first through hole in the first conductive pattern is employed instead of providing a special current control circuit in order to obtain the accuracy of the control. Therefore, an appropriate amount of illumination light can be obtained while suppressing an increase in the product cost of the lighting device.

The above lighting device may be configured so as to comprise:

a first substrate supporting the first PTC thermistor; and a second substrate supporting the semiconductor light emitting device and the first fixed resistor, wherein the heat conduction suppressor includes a gap separating the first substrate and the second substrate.

Heat generated from at least one of the first fixed resistor and the semiconductor light emitting device travels through the second substrate. According to the above-described configuration, the gap prevents such heat conduction to the first substrate.

In other words, it is possible to suppress an increase in the element temperature of the first PTC thermistor caused by heat generation of at least one of the first fixed resistor and the semiconductor light emitting element. Accordingly, the correspondence between the element temperature of the first PTC thermistor and the ambient temperature detected by the first PTC thermistor is made close to the intended one. As a result, the accuracy of the control of the current flowing through the semiconductor light emitting element based on the element temperature of the first PTC thermistor is improved.

In the above-described configuration, a simple method of separating two substrates by the gap is employed instead of providing a special current control circuit in order to obtain the accuracy of the control. Therefore, an appropriate amount of illumination light can be obtained while suppressing an increase in the product cost of the lighting device.

The above lighting device may be configured so as to comprise:

a second PTC thermistor supported on the first substrate, wherein the heat conduction suppressor includes a second slit formed on a heat conduction path between the first PTC thermistor and the second PTC thermistor in the first substrate.

Heat generated from the first PTC thermistor travels through the first substrate toward the second PTC thermistor. Similarly, heat generated from the second PTC thermistor travels through the first substrate toward the first PTC thermistor. According to the configuration as described above, since the second slit is formed on such a heat conduction path, it is possible to suppress heat conduction between the first PTC thermistor and the second PTC thermistor.

In other words, it is possible to suppress an increase in element temperature of each PTC thermistor caused by heat generation of other PTC thermistors. Accordingly, the correspondence between the element temperature of each PTC thermistor and the ambient temperature detected by the PTC thermistor can be made close to the intended one. As a result, the accuracy of the control of the current flowing through the semiconductor light emitting element based on the element temperature of each PTC thermistor is improved.

In the above configuration, a simple method of forming the second slit is employed instead of providing a special current control circuit in order to obtain the accuracy of the control. Therefore, an appropriate amount of illumination light can be obtained while suppressing an increase in the product cost of the lighting device.

The above lighting device may be configured so as to comprise:

a second PTC thermistor supported on the first substrate, wherein a second conductive pattern connecting the first PTC thermistor and the second PTC thermistor in parallel is formed on the first substrate; and wherein the heat conduction suppressor includes a portion in which a width of the second conductive pattern is narrowed.

Heat generated from the first PTC thermistor travels through the second conductive pattern toward the second PTC thermistor. Similarly, heat generated from the second PTC thermistor travels through the second conductive pattern toward the first PTC thermistor. According to the above configuration, since the width of a portion of the second conductive pattern located on such a heat conduction path is narrowed, heat conduction between the first PTC thermistor and the second PTC thermistor can be suppressed.

In other words, it is possible to suppress an increase in element temperature of each PTC thermistor caused by heat generation of other PTC thermistors. Accordingly, the correspondence between the element temperature of each PTC thermistor and the ambient temperature detected by the PTC thermistor can be made close to the intended one. As a result, the accuracy of the control of the current flowing through the semiconductor light emitting element based on the element temperature of each PTC thermistor is improved.

In the above configuration, a simple method of narrowing the width of a portion of the second conductive pattern is employed instead of providing a special current control circuit in order to obtain the accuracy of the control. Therefore, an appropriate amount of illumination light can be obtained while suppressing an increase in the product cost of the lighting device.

The above lighting device may be configured so as to comprise:

a second PTC thermistor supported on the first substrate, wherein a second conductive pattern connecting the first PTC thermistor and the second PTC thermistor in parallel is formed on the first principal surface of the first substrate; and wherein the heat conduction suppressor includes a second through hole electrically connecting the second conductive pattern and the conductive pattern formed on the second principal surface of the first substrate.

Heat generated from the first PTC thermistor is directed to the second PTC thermistor via the second conductive pattern. Such heat is dissipated through the first through hole and the second through hole to the conductive pattern formed on the second principal surface of the first substrate. Similarly, heat generated from the second PTC thermistor is directed to the first PTC thermistor via the second conductive pattern. Such heat is dissipated through the second through hole and the first through hole to the conductive pattern formed on the second principal surface of the first substrate. As a result, heat conduction between the first PTC thermistor and the second PTC thermistor can be suppressed.

In other words, it is possible to suppress an increase in element temperature of each PTC thermistor. Accordingly, the correspondence between the element temperature of each PTC thermistor and the ambient temperature detected by the PTC thermistor can be made close to the intended one. As a result, the accuracy of the control of the current flowing through the semiconductor light emitting element based on the element temperature of each PTC thermistor is improved.

In the above configuration, a simple method of forming the second through hole in the second conductive pattern is employed instead of providing a special current control circuit in order to obtain the accuracy of the control. Therefore, an appropriate amount of illumination light can be obtained while suppressing an increase in the product cost of the lighting device.

The above lighting device may be configured so as to comprise:

a second fixed resistor connected in parallel to a circuit in which the first fixed resistor and the first PTC thermistor are connected in series.

The second fixed resistor has a function of raising the value of the current flowing through the circuit in which the first fixed resistor and the first PTC thermistor are connected in series. As a result, even if the resistance value of the first PTC thermistor increases due to the temperature rise so that the current flowing through each light emitting element is limited, a relatively high amount of light can be maintained. In other words, this configuration is suitable for increasing the brightness of the light source.

The above lighting device may be configured so as to comprise:

a third fixed resistor connected in parallel to the first PTC thermistor.

The third fixed resistor has a function of adjusting the sensitivity (i.e. the temperature at which the current limitation is initiated and the extent of the limitation) of the first PTC thermistor. As a result, the operation of the light source driving circuit can be adjusted by a simple method of merely adding a fixed resistor having an appropriate value.

The above lighting device may be configured so as to comprise:

a reflector configured to reflect light emitted from the semiconductor light emitting device, wherein the first fixed resistor and the first PTC thermistor are not covered by the reflector.

According to such a configuration, the heat dissipation performance of the first fixed resistor and the first PTC thermistor can be improved. Accordingly, for example, it is possible to suppress the influence of the heat caged in the reflector on the element temperature of the first PTC thermistor. As a result, the accuracy of the control of the current flowing through the semiconductor light emitting element based on the element temperature of the first PTC thermistor is improved.

The above lighting device may be configured such that:

the first fixed resistor is supported on a surface of the first substrate that is configured to be directed upward.

Even with such a configuration, the heat dissipation performance of the first fixed resistor can be improved.

DESCRIPTION OF EMBODIMENTS

Examples of embodiments will be described below in detail with reference to the accompanying drawings. In each of the drawings used in the following descriptions, the scale is appropriately changed in order to make each of the members have a recognizable size.

In the accompanying drawings, an arrow F represents a forward direction of the illustrated structure. An arrow B represents a rearward direction of the illustrated structure. An arrow U represents an upward direction of the illustrated structure. An arrow D represents a downward direction of the illustrated structure. An arrow L represents a leftward direction of the illustrated structure. An arrow R represents a rightward direction of the illustrated structure. The terms of "left" and "right" used in the following descriptions represent the left-right directions as viewed from the driver's seat. Such definitions are for convenience of description and are not intended to limit the direction in which the structure is actually used.

Figure 1:
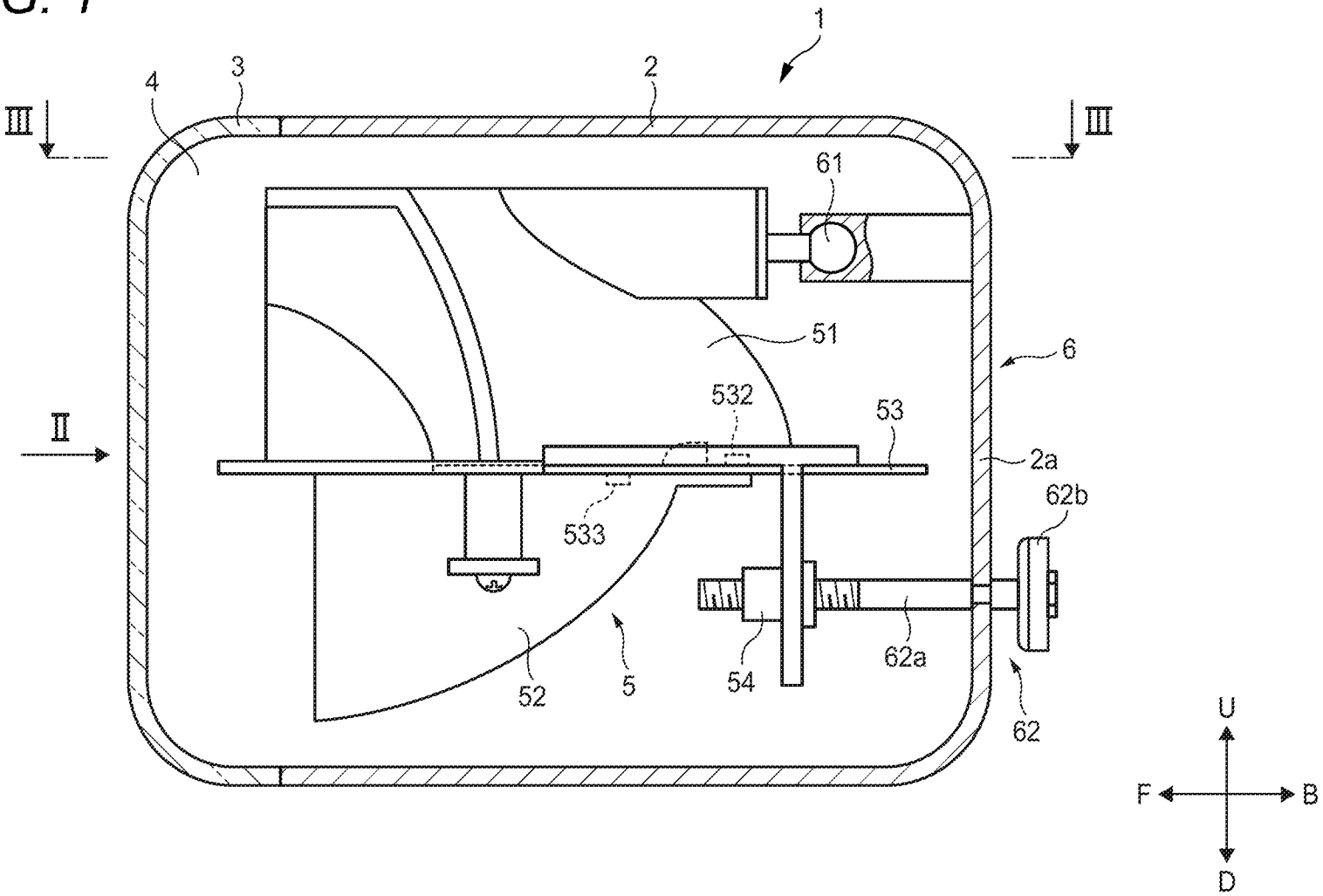
FIG. 1 is a cross-sectional left side view illustrating a configuration of a headlamp device according to one embodiment.

FIG. 1 illustrates a headlamp device 1 according to one embodiment. The headlamp device 1 is an example of a lighting device adapted to be mounted on a vehicle.

The headlamp device 1 includes a housing 2 and a translucent cover 3. The housing 2 and the translucent cover 3 define a lamp chamber 4.

Figure 2:
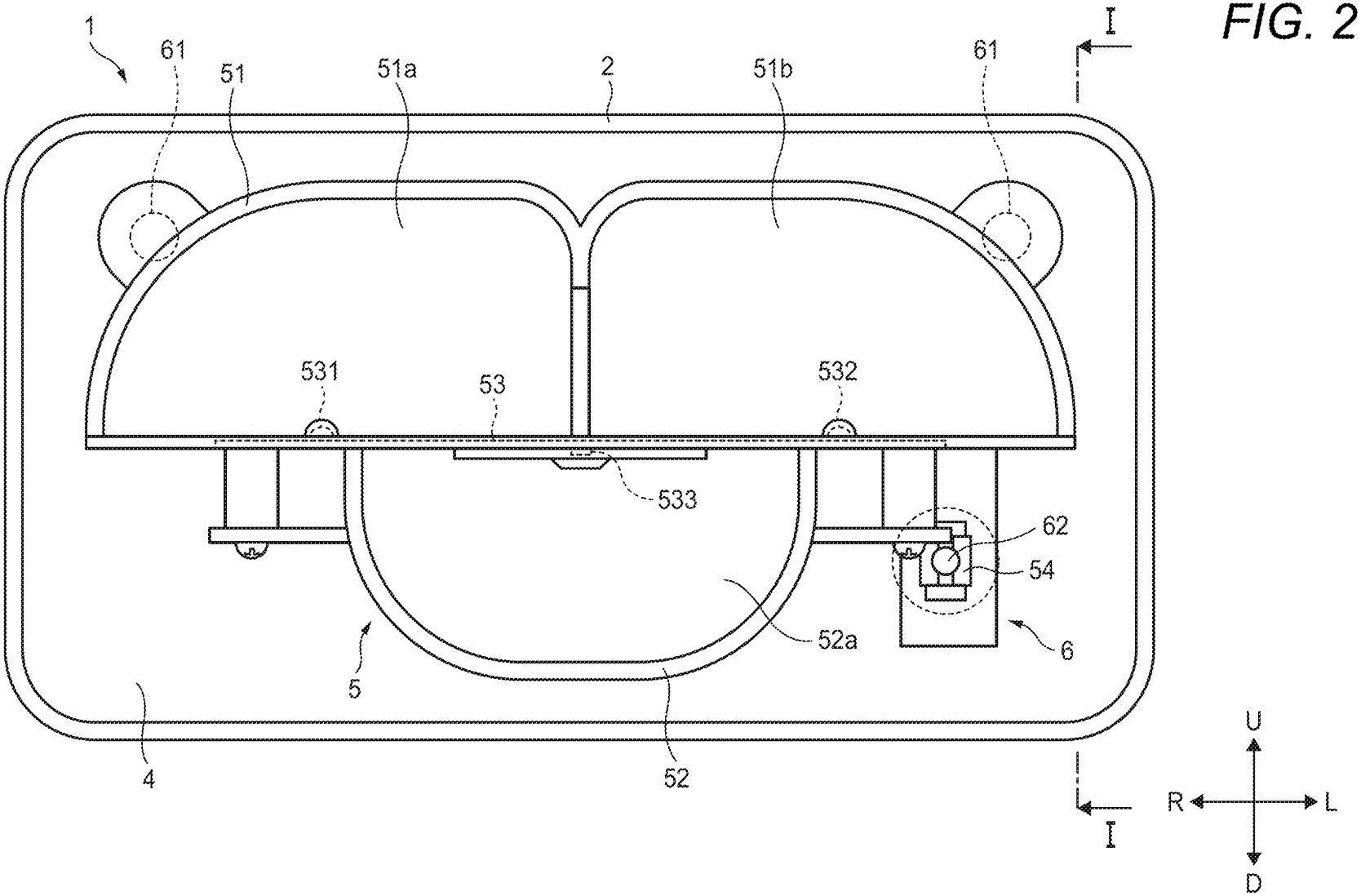
FIG. 2 is a front view illustrating the configuration of the headlamp device.
Figure 3:
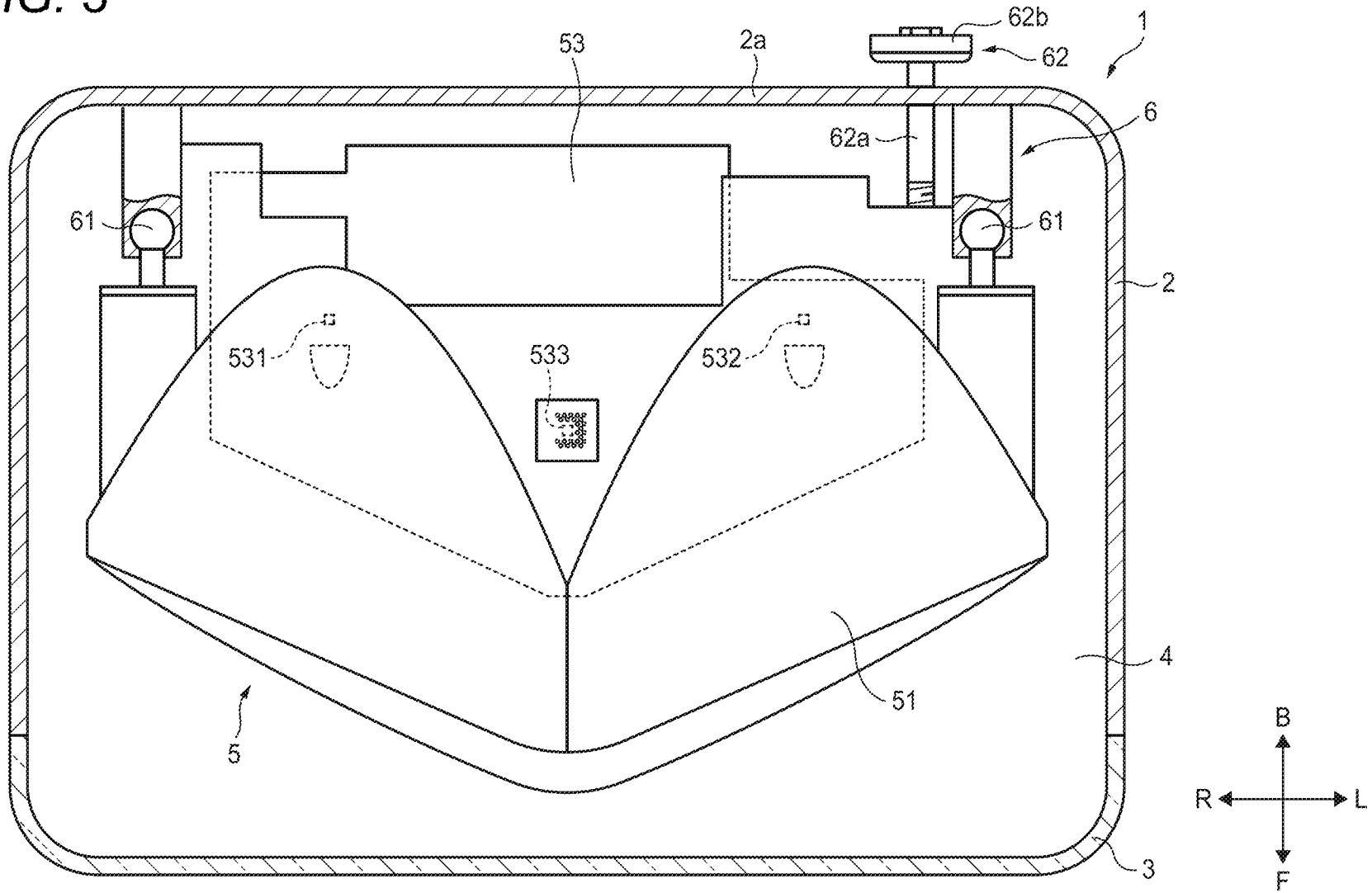
FIG. 3 is a cross-sectional plan view illustrating the configuration of the headlamp device.

FIG. 2 illustrates an appearance of the headlamp device 1 as seen from the direction along an arrow II in FIG. 1. However, illustration of the translucent cover 3 is omitted. FIG. 1 illustrates a cross-section taken along a line I-I in FIG. 2 and seen from the direction of arrows. FIG. 3 illustrates a cross-section of the headlamp device 1 taken along a line III-III in FIG. 1 and seen from the direction of arrows.

The headlamp device 1 includes a lamp unit 5. The lamp unit 5 is disposed in the lamp chamber 4. The lamp unit 5 includes a first reflector 51, a second reflector 52, and a substrate 53.

Figure 4:
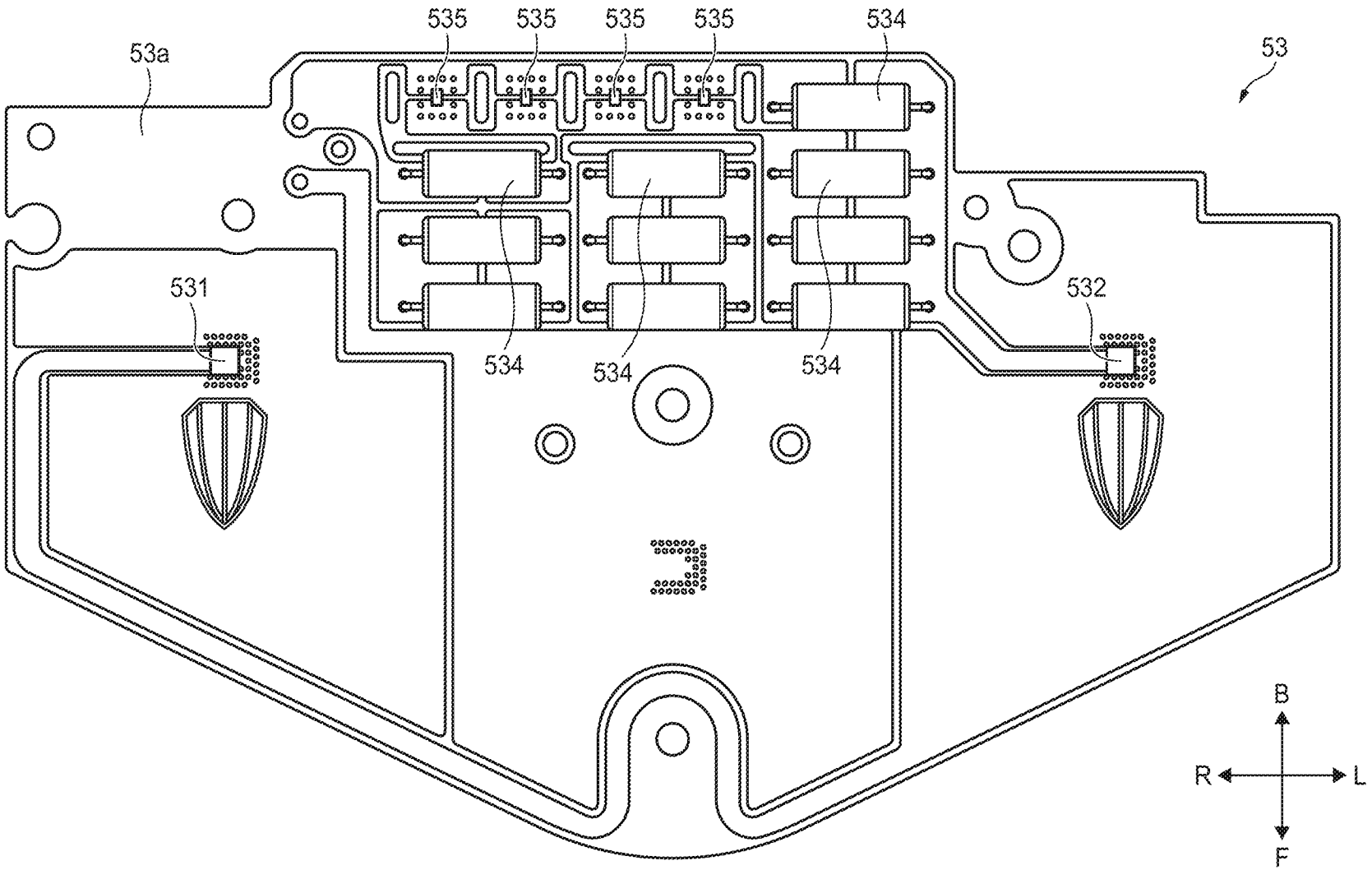
FIG. 4 illustrates an upper surface of a substrate in the headlamp device.
Figure 5:
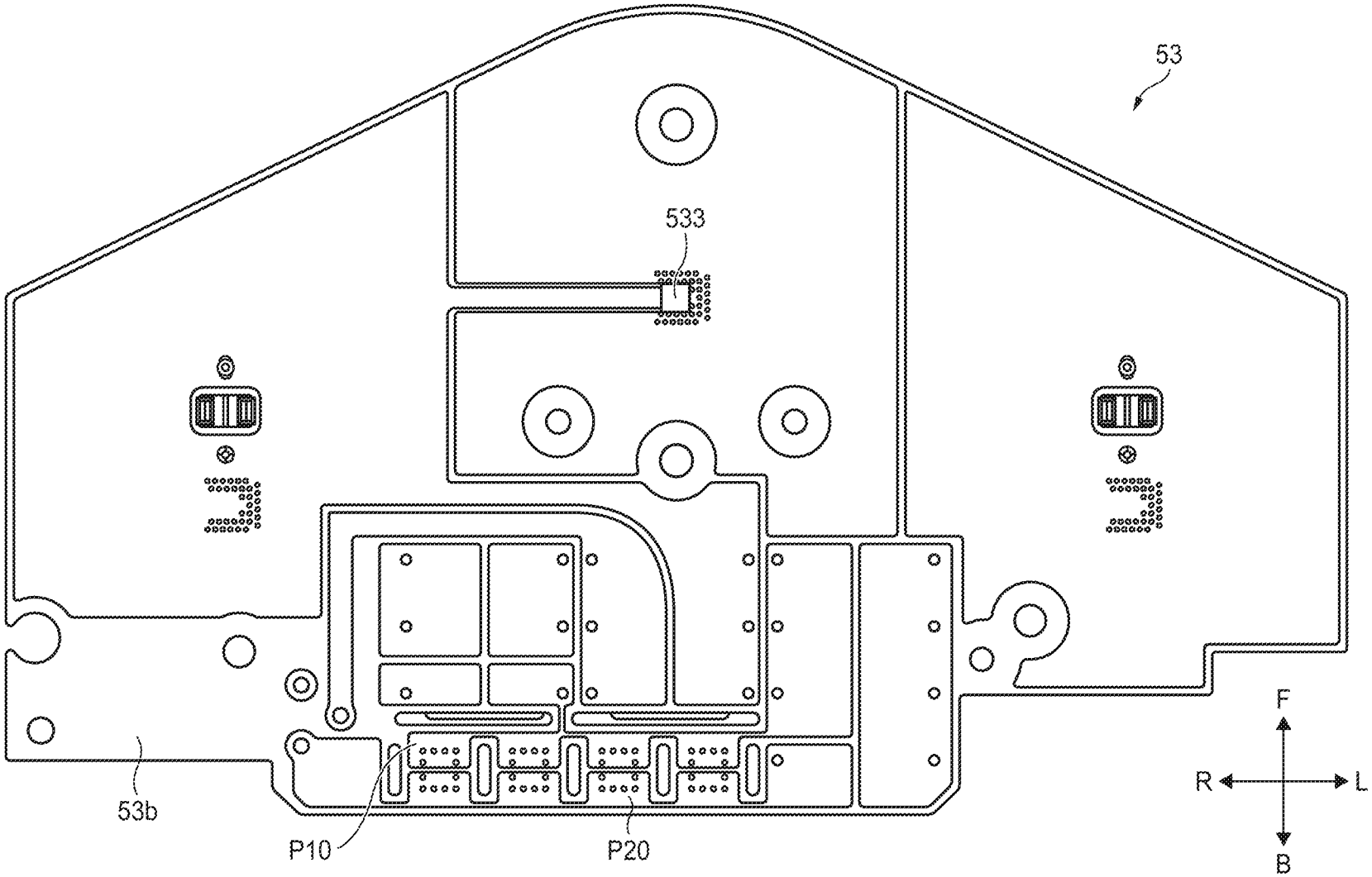
FIG. 5 illustrates a lower surface of the substrate.

The substrate 53 has an upper surface 53*a* and a lower surface 53*b*. FIG. 4 illustrates the appearance of the upper surface 53*a* of the substrate 53. FIG. 5 illustrates the appearance of the lower surface 53*b* of the substrate 53.

The lamp unit 5 includes a first light emitting element 531, a second light emitting element 532, and a third light emitting element 533. As illustrated in FIG. 4, the first light emitting element 531 and the second light emitting element 532 are supported on the upper surface 53*a* of the substrate 53. As illustrated in FIG. 5, the third light emitting element 533 is supported by the lower surface 53*b* of the substrate 53. Each of the first light emitting element 531, the second light emitting element 532, and the third light emitting element 533 is a semiconductor light emitting element such as a light emitting diode (LED).

As illustrated in FIG. 2, the first reflector 51 has a first reflective surface 51*a* and a second reflective surface 51*b*. The first reflective surface 51*a* is disposed so as to reflect the light emitted from the first light emitting element 531 in a predetermined direction. The second reflective surface 51*b* is disposed so as to reflect the light emitted from the second light emitting element 532 in a predetermined direction. In the present embodiment, the light reflected by the first reflector 51 forms a low beam pattern in a region ahead of the vehicle.

As illustrated in FIG. 1, the second reflector 52 has a third reflective surface 52*a*. The third reflective surface 52*a* is disposed so as to reflect the light emitted from the third light emitting element 533 in a predetermined direction. In this embodiment, the light reflected by the second reflector 52 forms a high beam pattern in a region ahead of the vehicle.

As illustrated in FIGS. 1 to 3, the headlamp device 1 includes an optical axis adjusting mechanism 6. The lamp unit 5 is supported by the housing 2 via an optical axis adjusting mechanism 6. The optical axis adjusting mechanism 6 includes a pivot shaft 61 and an aiming screw 62.

The pivot shaft 61 couples the lamp unit 5 and the housing 2 via a ball joint.

The aiming screw 62 has a shaft portion 62*a* and an actuating portion 62*b*. The shaft portion 62*a* extends in a front-rear direction through a back plate 2*a* of the housing 2. The actuating portion 62*b* is disposed behind the back plate 2*a*, that is, on the outer side of the housing 2. Screw grooves are formed on an outer peripheral surface of the shaft portion 62*a*. A nut 54 is formed in a portion of the lamp unit 5, and is screwed into the screw grooves.

When the actuating portion 62*b* is rotated by a predetermined tool, the rotation of the aiming screw 62 is converted into a motion for changing the attitude of the lamp unit 5 in a vertical plane (in a plane including the front-rear direction and an up-down direction in FIG. 2) via the nut 54. Thus, the orientations of the optical axes of the first light emitting element 531, the second light emitting element 532, and the third light emitting element 533 can be adjusted in the vertical plane. It should be noted that the "vertical plane" need not coincide with a strict vertical plane.

As illustrated in FIG. 4, the lamp unit 5 includes a plurality of resistance elements 534 and a plurality of PTC (positive temperature coefficient) thermistors 535. The PTC thermistor 535 is a thermistor having a positive correlation between a resistance value and a temperature. The plurality of resistance elements 534 and the plurality of PTC thermistors 535 are supported on the upper surface 53*a* of the substrate 53.

Figure 6:
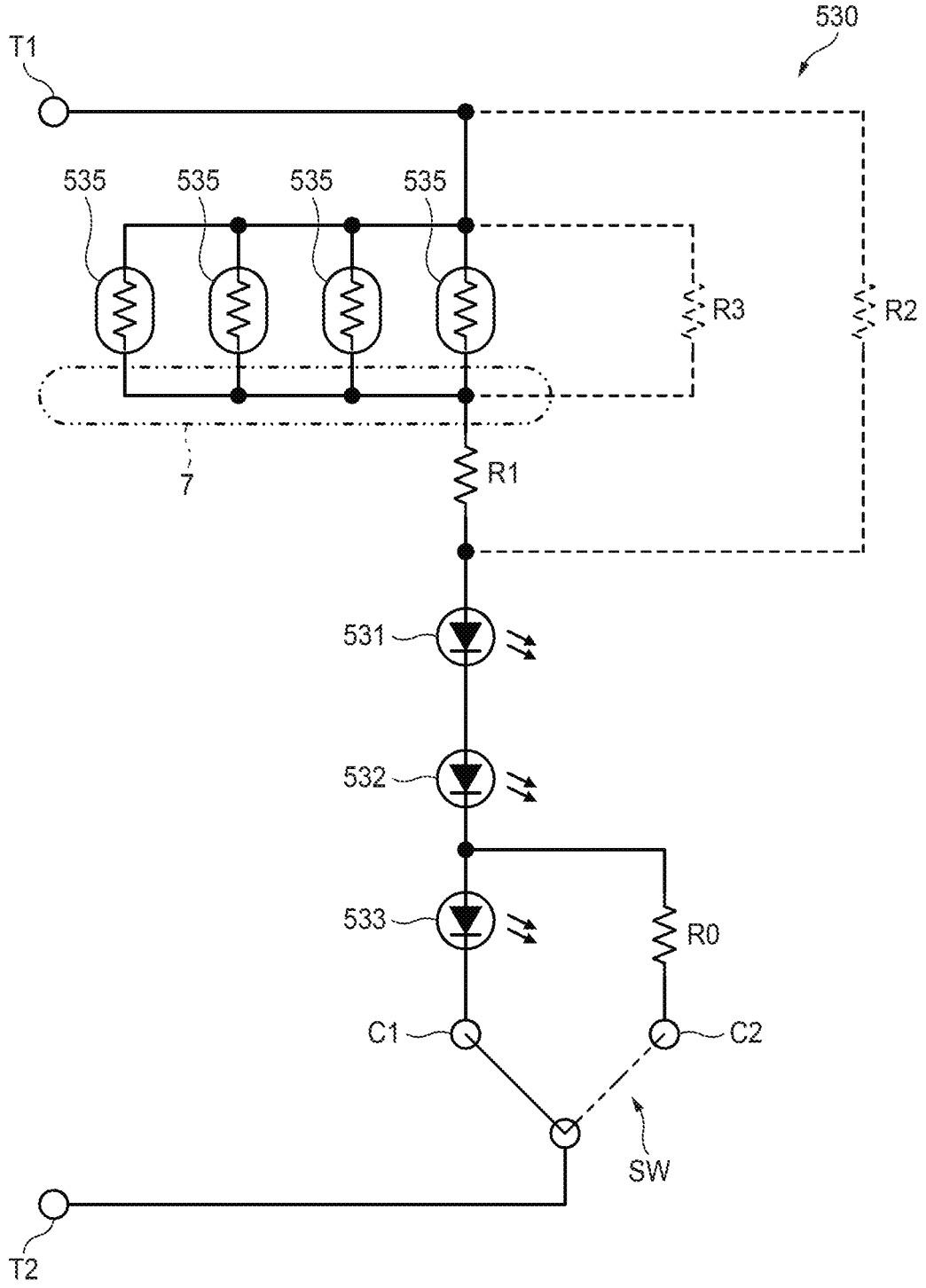
FIG. 6 illustrates a light source driving circuit in the headlamp device.

The first light emitting element 531, the second light emitting element 532, the third light emitting element 533, the plurality of resistance elements 534, and the plurality of PTC thermistors 535 form a portion of a light source driving circuit 530 illustrated in FIG. 6.

The light source driving circuit 530 includes a terminal T1. The terminal T1 is electrically connected to a voltage source (not illustrated). The voltage source may be provided in the headlamp device 1, or may be provided in a vehicle on which the headlamp device 1 is mounted.

The light source driving circuit 530 includes a terminal T2. The terminal T2 is electrically connected to a common potential such as a ground potential.

The plurality of PTC thermistors 535 are connected in parallel. The plurality of PTC thermistors 535 are connected in series with the terminal T1.

The plurality of resistance elements 534 include a first fixed resistor R1. The first fixed resistor R1 is connected in series with the plurality of PTC thermistors 535.

The first light emitting element 531 is connected in series with the first fixed resistor R1. The second light emitting element 532 is connected in series with the first light emitting element 531. The third light emitting element 533 is connected in series with the second light emitting element 532.

The light source driving circuit 530 includes a switching circuit SW. The switching circuit SW is configured to be switchable between a first path C1 that connects the third light emitting element 533 to the terminal T2 in series and a second path C2 that bypasses the third light emitting element 533 and connects the second light emitting element 532 to the terminal T2 in series via the fixed resistor R0.

When the switching circuit SW selects the first path C1, all of the first light emitting element 531, the second light emitting element 532, and the third light emitting element 533 are turned on so that the low beam pattern and the high beam pattern are formed in the region ahead of the vehicle. When the switching circuit SW selects the second path C2, only the first light emitting element 531 and the second light emitting element 532 are turned on so that only a low beam pattern is formed in the region ahead of the vehicle.

The PTC thermistor 535 has a function of preventing the temperature of each light emitting element from exceeding a junction temperature. If an overcurrent continues to flow in each light emitting element, the temperature of the light emitting element may exceed the junction temperature. Alternatively, the rise of ambient temperature of each light emitting element may cause the temperature of the light emitting element to exceed the junction temperature. As described above, the PTC thermistor 535 has a positive correlation between its resistance value and temperature. Therefore, the higher the temperature of the element, the higher the resistance value. The PTC thermistor 535 utilizes this characteristic to prevent the occurrence of the above-described situation.

For example, when the voltage supplied from the voltage source rises to increase the current flowing through the PTC thermistor 535, the PTC thermistor 535 itself generates heat to increase the element temperature. As a result, the resistance value of the PTC thermistor 535 rises, and the current flowing through each light emitting element is limited. Therefore, a situation in which an overcurrent flows in each light emitting element can be avoided.

Alternatively, the element temperature of the PTC thermistor 535 rises also by an increase in the temperature of the environment in which each light emitting element is disposed, such as the lamp chamber 4. As a result, the resistance value of the PTC thermistor 535 rises, and the current flowing through each light emitting element is limited. Accordingly, the temperature rise of each light emitting element is suppressed.

In other words, in order to obtain an appropriate amount of illumination light, it is necessary to accurately grasp the ambient temperature of the light emitting element through the PTC thermistor. However, the inventors related to the presently disclosed subject matter have found the following facts. Heat generated from circuit elements such as a resistance element and a light emitting element included in the light source driving circuit is transmitted to the PTC thermistor through the substrate. This heat causes the element temperature of the PTC thermistor to rise, so that an inherent correspondence between the element temperature and the ambient temperature cannot be maintained. As a result, the PTC thermistor cannot accurately grasp the ambient temperature of the light emitting element.

Based on the above findings, the headlamp device 1 according to the present embodiment includes a heat conduction suppressor 7 that suppresses heat conduction from at least one of the resistance element 534, the first light emitting element 531, the second light emitting element 532, and the third light emitting element 533 to the PTC thermistor 535.

According to such a configuration, it is possible to suppress an increase in the element temperature of the PTC thermistor 535 caused by heat generation of other circuit elements. This allows the correspondence between the element temperature and the ambient temperature to be brought closer to the intended one. Accordingly, the accuracy of the control of the current flowing to the light emitting element based on the element temperature of the PTC thermistor 535 is improved. As a result, in the headlamp device 1 using a semiconductor light emitting element as a light source, an illumination light having an appropriate amount of light can be obtained.

Figure 7:
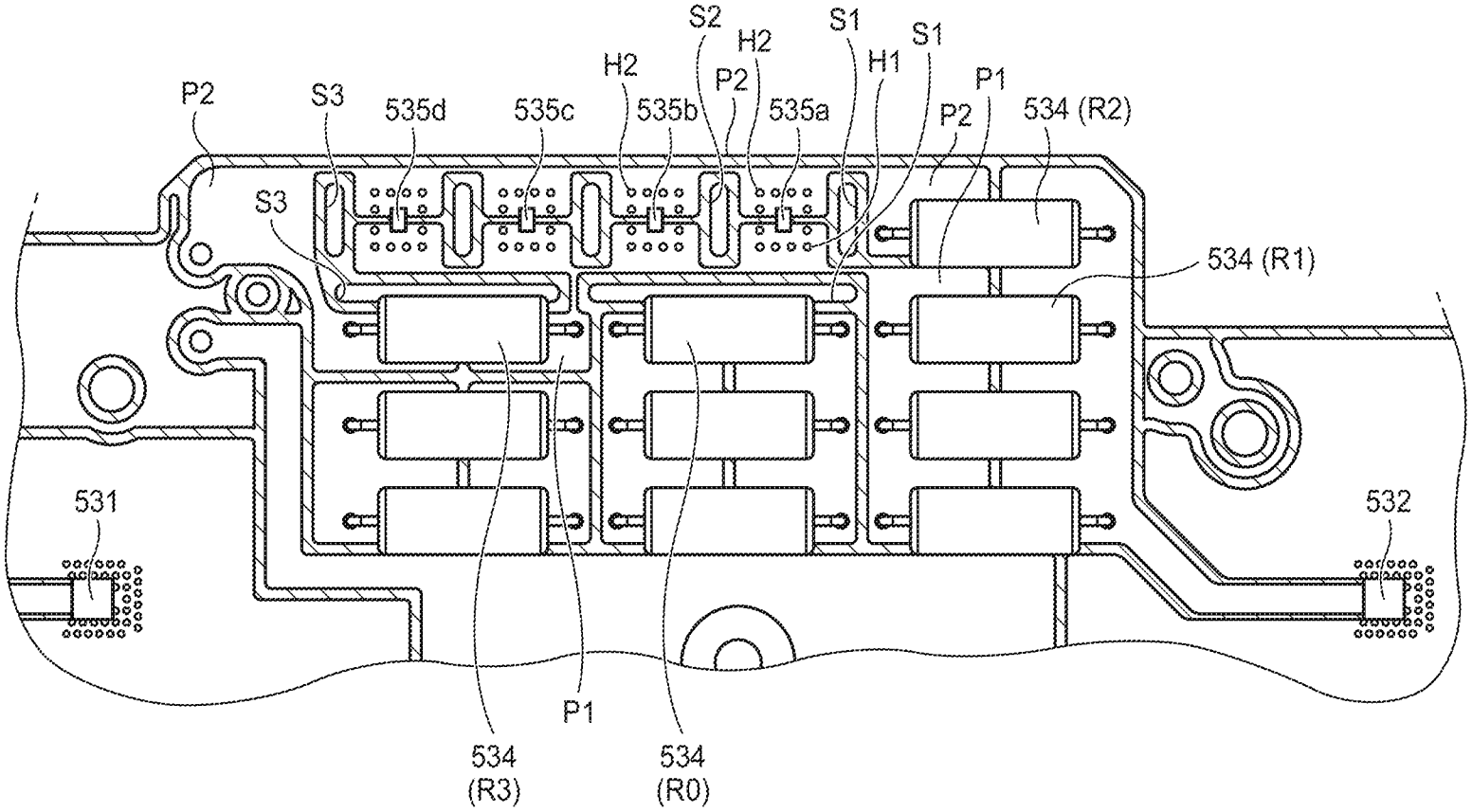
FIG. 7 is an enlarged view illustrating a portion of the substrate illustrated in FIG. 4.

Next, a specific example of the heat conduction suppressor 7 will be described with reference to FIG. 7. FIG. 7 is an enlarged view of a portion of the upper surface 53*a* of the substrate 53 illustrated in FIG. 5. The plurality of PTC thermistors 535 includes four PTC thermistors 535*a*, 535*b*, 535*c*, and 535*d*. The resistance element corresponding to the first fixed resistor R1 in FIG. 5 is denoted by a reference symbol 534 (R1).

The heat conduction suppressor 7 includes two slits S1 formed in the substrate 53. Each slit S1 communicates the upper surface 53*a* and the lower surface 53*b* of the substrate 53. Each slit S1 is formed between the PTC thermistor 535*a* and the resistance element 534 (R1). In other words, each slit S1 is formed on a heat conduction path from the resistance element 534 (R1) to the PTC thermistor 535*a*. The substrate 53 is an example of a first substrate. The slit S1 is an example of a first slit. The PTC thermistor 535*a* is an example of a first PTC thermistor.

Heat generated from the resistance element 534 (R1) during operation of the light source driving circuit 530 travels through the substrate 53 toward the PTC thermistor 535*a*. According to the configuration described above, since the slit S1 is formed on such a heat conduction path, heat conduction from the resistance element 534 (R1) to the PTC thermistor 535*a* can be suppressed.

In other words, it is possible to suppress an increase in element temperature of the PTC thermistor 535*a* caused by heat generation of the resistance element 534 (R1). As a result, the correspondence between the element temperature of the PTC thermistor 535*a* and the ambient temperature detected by the PTC thermistor 535*a* can be made close to the intended one. Therefore, the accuracy of the control of the current flowing through the first light emitting element 531, the second light emitting element 532, and the third light emitting element 533 based on the element temperature of the PTC thermistor 535*a* is improved.

In this example, a simple method of forming the slit S1 is employed instead of providing a special current control circuit in order to obtain the accuracy of the control. Therefore, an appropriate amount of illumination light can be obtained while suppressing an increase in the product cost of the headlamp device 1.

A conductive pattern P1 is formed on the upper surface 53*a* of the substrate 53. The conductive pattern P1 electrically connects the resistance element 534 (R1) and the PTC thermistor 535*a*. The heat conduction suppressor 7 includes a portion in which the width of the conductive pattern P1 is narrowed. The upper surface 53*a* is an example of the first principal surface. The conductive pattern P1 is an example of the first conductive pattern.

Heat generated from the resistance element 534 (R1) during operation of the light source driving circuit 530 travels through the conductive pattern P1 toward the PTC thermistor 535*a*. According to the above-described configuration, since the width of a portion of the conductive pattern P1 located on such a heat conduction path is narrowed, heat conduction from the resistance element 534 (R1) to the PTC thermistor 535*a* can be suppressed.

In other words, it is possible to suppress an increase in element temperature of the PTC thermistor 535*a* caused by heat generation of the resistance element 534 (R1). As a result, the correspondence between the element temperature of the PTC thermistor 535*a* and the ambient temperature detected by the PTC thermistor 535*a* can be made close to the intended one. Therefore, the accuracy of the control of the current flowing through the first light emitting element 531, the second light emitting element 532, and the third light emitting element 533 based on the element temperature of the PTC thermistor 535*a* is improved.

In this example, a simple method of narrowing the width of a portion of the conductive pattern P1 is employed instead of providing a special current control circuit in order to obtain the accuracy of the control. Therefore, an appropriate amount of illumination light can be obtained while suppressing an increase in the product cost of the headlamp device 1.

A plurality of through holes H1 are formed in a region of the conductive pattern P1 located in the vicinity of the PTC thermistor 535*a*. The inner peripheral wall of each through hole H1 is covered with a conductive member. Thus, each through hole H1 electrically connects the conductive pattern P1 formed on the upper surface 53*a* of the substrate 53 to the conductive pattern P10 (see FIG. 5) formed on the lower surface 53*b* of the substrate 53. The heat conduction suppressor 7 includes each through hole H1. The through hole H1 is an example of the first through hole. The lower surface 53*b* is an example of the second principal surface.

Heat generated from the resistance element 534 (R1) during operation of the light source driving circuit 530 travels through the conductive pattern P1 toward the PTC thermistor 535*a*. According to the above-described configuration, the heat reaching the vicinity of the PTC thermistor 535*a* is dissipated to the conductive pattern P10 formed on the lower surface 53*b* of the substrate 53 through the through holes H1. As a result, heat conduction from the resistance element 534 (R1) to the PTC thermistor 535*a* can be suppressed. Each through hole H1 also has a function of releasing heat generated from the PTC thermistor 535*a*.

In other words, it is possible to suppress an increase in the element temperature of the PTC thermistor 535*a*. As a result, the correspondence between the element temperature of the PTC thermistor 535*a* and the ambient temperature detected by the PTC thermistor 535*a* can be made close to the intended one. Therefore, the accuracy of the control of the current flowing through the first light emitting element 531, the second light emitting element 532, and the third light emitting element 533 based on the element temperature of the PTC thermistor 535*a* is improved.

In this example, a simple method of forming the through hole H1 in the conductive pattern P1 is employed instead of providing a special current control circuit in order to obtain the accuracy of the control. Therefore, an appropriate amount of illumination light can be obtained while suppressing an increase in the product cost of the headlamp device 1.

For the same reason, similar through holes are formed in the region of the conductive pattern P1 located in the vicinity of each of the PTC thermistors 535*b*, 535*c*, and 535*d*.

As illustrated in FIG. 7, the PTC thermistor 535*a* and the PTC thermistor 535*b* are connected in parallel via the conductive pattern P1 and the conductive pattern P2. By connecting a plurality of PTC thermistors in parallel, the amount of current flowing to each light emitting element can be increased. In other words, this configuration is suitable for increasing the brightness of the light source.

The heat conduction suppressor 7 includes a slit S2 formed in the substrate 53. The slit S2 communicates the upper surface 53*a* and the lower surface 53*b* of the substrate 53. The slit S2 is formed between the PTC thermistor 535*a* and the PTC thermistor 535*b*. In other words, the slit S2 is formed on the heat conduction path between the PTC thermistor 535*a* and the PTC thermistor 535*b*. The substrate 53 is an example of a first substrate. The slit S2 is an example of the second slit. The PTC thermistor 535*a* is an example of a first PTC thermistor. The PTC thermistor 535*b* is an example of a second PTC thermistor.

Heat generated from the PTC thermistor 535*a* during operation of the light source driving circuit 530 travels through the substrate 53 toward the PTC thermistor 535*b*. Similarly, heat generated from the PTC thermistor 535*b* travels through the substrate 53 toward the PTC thermistor 535*a*. According to the configuration as described above, since the slit S2 is formed on such a heat conduction path, heat conduction between the PTC thermistor 535*a* and the PTC thermistor 535*b* can be suppressed.

In other words, it is possible to suppress an increase in element temperature of each PTC thermistor 535 caused by the heat generation of the other PTC thermistors 535. As a result, the correspondence between the element temperature of each PTC thermistor 535 and the ambient temperature detected by the PTC thermistor 535 can be made close to the intended one. Therefore, the accuracy of the control of the current flowing through the first light emitting element 531, the second light emitting element 532, and the third light emitting element 533 based on the element temperature of each PTC thermistor 535 is improved.

In this example, a simple method of forming the slit S2 is employed instead of providing a special current control circuit in order to obtain the accuracy of the control. Therefore, an appropriate amount of illumination light can be obtained while suppressing an increase in the product cost of the headlamp device 1.

For the same reason, a similar slit is formed on the heat conduction path between the PTC thermistor 535*b* and the PTC thermistor 535*c*. A similar slit is also formed on the heat conduction path between the PTC thermistor 535*c* and the PTC thermistor 535*d*.

The heat conduction suppressor 7 includes a portion in which the width of the conductive pattern P1 is narrowed. This portion is located between the PTC thermistor 535*b* and the PTC thermistor 535*c* to connect them in parallel. The portion where the width of the conductive pattern P1 is narrowed is an example of the second conductive pattern. The heat conduction suppressor 7 includes a portion in which the width of the conductive pattern P2 is narrowed. This portion is located between the PTC thermistor 535*b* and the PTC thermistor 535*c* to connect them in parallel. The portion where the width of the conductive pattern P2 is narrowed is an example of the second conductive pattern.

Heat generated from the PTC thermistor 535*a* during the operation of the light source driving circuit 530 travels through the conductive pattern P1 and the conductive pattern P2 toward the PTC thermistor 535*b*. Similarly, heat generated from the PTC thermistor 535*b* travels through the conductive pattern P1 and the conductive pattern P2 toward the PTC thermistor 535*a*. According to the configuration as described above, since the width of a portion of the conductive pattern P1 and the width of a portion of the conductive pattern P2 located on such a heat conduction path are narrowed, heat conduction between the PTC thermistor 535*a* and the PTC thermistor 535*b* can be suppressed.

In other words, it is possible to suppress an increase in element temperature of each PTC thermistor 535 caused by the heat generation of the other PTC thermistors 535. As a result, the correspondence between the element temperature of each PTC thermistor 535 and the ambient temperature detected by the PTC thermistor 535 can be made close to the intended one. Therefore, the accuracy of the control of the current flowing through the first light emitting element 531, the second light emitting element 532, and the third light emitting element 533 based on the element temperature of each PTC thermistor 535 is improved.

In this example, a simple method of narrowing the width of a portion of the conductive pattern P1 and the width of a portion of the conductive pattern P2 is employed instead of providing a special current control circuit in order to obtain the accuracy of the control. Therefore, an appropriate amount of illumination light can be obtained while suppressing an increase in the product cost of the headlamp device 1.

For the same reason, the width of the conductive pattern P1 and the width of the conductive pattern P2 located on the heat conduction path between the PTC thermistor 535*b* and the PTC thermistor 535*c* are also narrowed. The width of the conductive pattern P1 and the width of the conductive pattern P2 located on the heat conduction path between the PTC thermistor 535*c* and the PTC thermistor 535*d* are also narrowed.

A plurality of through holes H2 are formed in a region of the conductive pattern P2 located in the vicinity of each of the PTC thermistors 535*a* and 535*b*. The inner peripheral wall of each through hole H2 is covered with a conductive member. Thus, each through hole H2 electrically connects the conductive pattern P1 formed on the upper surface 53*a* of the substrate 53 to the conductive pattern P20 (see FIG. 5) formed on the lower surface 53*b* of the substrate 53. The heat conduction suppressor 7 includes each through hole H2. The through hole H2 is an example of the second through hole. The lower surface 53*b* is an example of the second principal surface.

Heat generated from the PTC thermistor 535*a* during the operation of the light source driving circuit 530 is directed to the PTC thermistor 535*b* via the conductive pattern P2. Such heat is dissipated to the conductive pattern 20 formed on the lower surface 53*b* of the substrate 53 through the through holes H1 and H2. Similarly, heat generated from the PTC thermistor 535*b* is directed to the PTC thermistor 535*a* via the conductive pattern P2. Such heat is dissipated to the conductive pattern P20 formed on the lower surface 53*b* of the substrate 53 through the through holes H1 and H2. As a result, heat conduction between the PTC thermistor 535*a* and the PTC thermistor 535*b* can be suppressed.

In other words, it is possible to suppress an increase in the element temperature of each PTC thermistor 535. As a result, the correspondence between the element temperature of each PTC thermistor 535 and the ambient temperature detected by the PTC thermistor 535 can be made close to the intended one. Therefore, the accuracy of the control of the current flowing through the first light emitting element 531, the second light emitting element 532, and the third light emitting element 533 based on the element temperature of each PTC thermistor 535 is improved.

In this example, a simple method of forming the through hole H2 in the conductive pattern P2 is employed instead of providing a special current control circuit in order to obtain the accuracy of the control. Therefore, an appropriate amount of illumination light can be obtained while suppressing an increase in the product cost of the headlamp device 1.

For the same reason, similar through holes are formed in the region of the conductive pattern P2 located in the vicinity of each of the PTC thermistors 535*c* and 535*d*.

Each of the through holes H1 formed in a region located in the vicinity of each of the PTC thermistors 535*a*, 535*b*, 535*c*, and 535*d* in the conductive pattern P1 also has the same function.

The heat conduction suppressor 7 includes two slits S3 formed in the substrate 53. Each slit S3 communicates the upper surface 53*a* and the lower surface 53*b* of the substrate 53. Each slit S3 is formed between each PTC thermistor 535 and the first light emitting element 531. In other words, each slit S3 is formed on a heat conduction path from the first light emitting element 531 to each PTC thermistor 535. The substrate 53 is an example of a first substrate. The slit S3 is an example of the first slit. The PTC thermistor 535 is an example of the first PTC thermistor.

Heat generated from the first light emitting element 531 during operation of the light source driving circuit 530 travels through the substrate 53 toward each PTC thermistor 535. According to the configuration as described above, since the slit S3 is formed on such a heat conduction path, heat conduction from the first light emitting element 531 to each PTC thermistor 535 can be suppressed.

In other words, it is possible to suppress an increase in element temperature of each PTC thermistor 535 caused by heat generation of the first light emitting element 531. As a result, the correspondence between the element temperature of each PTC thermistor 535 and the ambient temperature detected by each PTC thermistor 535 can be made close to the intended one. Therefore, the accuracy of the control of the current flowing through the first light emitting element 531, the second light emitting element 532, and the third light emitting element 533 based on the element temperature of each PTC thermistor 535 is improved.

In this example, a simple method of forming the slit S3 is employed instead of providing a special current control circuit in order to obtain the accuracy of the control. Therefore, an appropriate amount of illumination light can be obtained while suppressing an increase in the product cost of the headlamp device 1.

The above-described two slits S1 are formed between each PTC thermistor 535 and the second light emitting element 532. In other words, each slit S1 is formed on a heat conduction path from the second light emitting element 532 to each PTC thermistor 535. The PTC thermistor 535 is an example of the first PTC thermistor.

Heat generated from the second light emitting element 532 during operation of the light source driving circuit 530 travels through the substrate 53 toward each PTC thermistor 535. According to the above configuration, since the slit S1 is formed on such a heat conduction path, heat conduction from the second light emitting element 532 to each PTC thermistor 535 can be suppressed.

In other words, it is possible to suppress an increase in element temperature of each PTC thermistor 535 caused by heat generation of the second light emitting element 532. As a result, the correspondence between the element temperature of each PTC thermistor 535 and the ambient temperature detected by each PTC thermistor 535 can be made close to the intended one. Therefore, the accuracy of the control of the current flowing through the first light emitting element 531, the second light emitting element 532, and the third light emitting element 533 based on the element temperature of each PTC thermistor 535 is improved.

In this example, a simple method of forming the slit S1 is employed instead of providing a special current control circuit in order to obtain the accuracy of the control. Therefore, an appropriate amount of illumination light can be obtained while suppressing an increase in the product cost of the headlamp device 1.

In the embodiment described with reference to FIGS. 4 to 7, the PTC thermistor 535, the first fixed resistor R1, and the first light emitting element 531 are connected in series in this order from the voltage source side. However, if the series connection is made, the order of the PTC thermistor 535, the first fixed resistor R1, and the first light emitting element 531 is arbitrary. The connection order of the first light emitting element 531, the second light emitting element 532, and the third light emitting element 533 is also arbitrary. Therefore, the light emitting element subjected to the direct electrical connection with the PTC thermistor 535 or the first fixed resistor R1 can be arbitrarily selected from the first light emitting element 531, the second light emitting element 532, and the third light emitting element 533.

Figure 8:
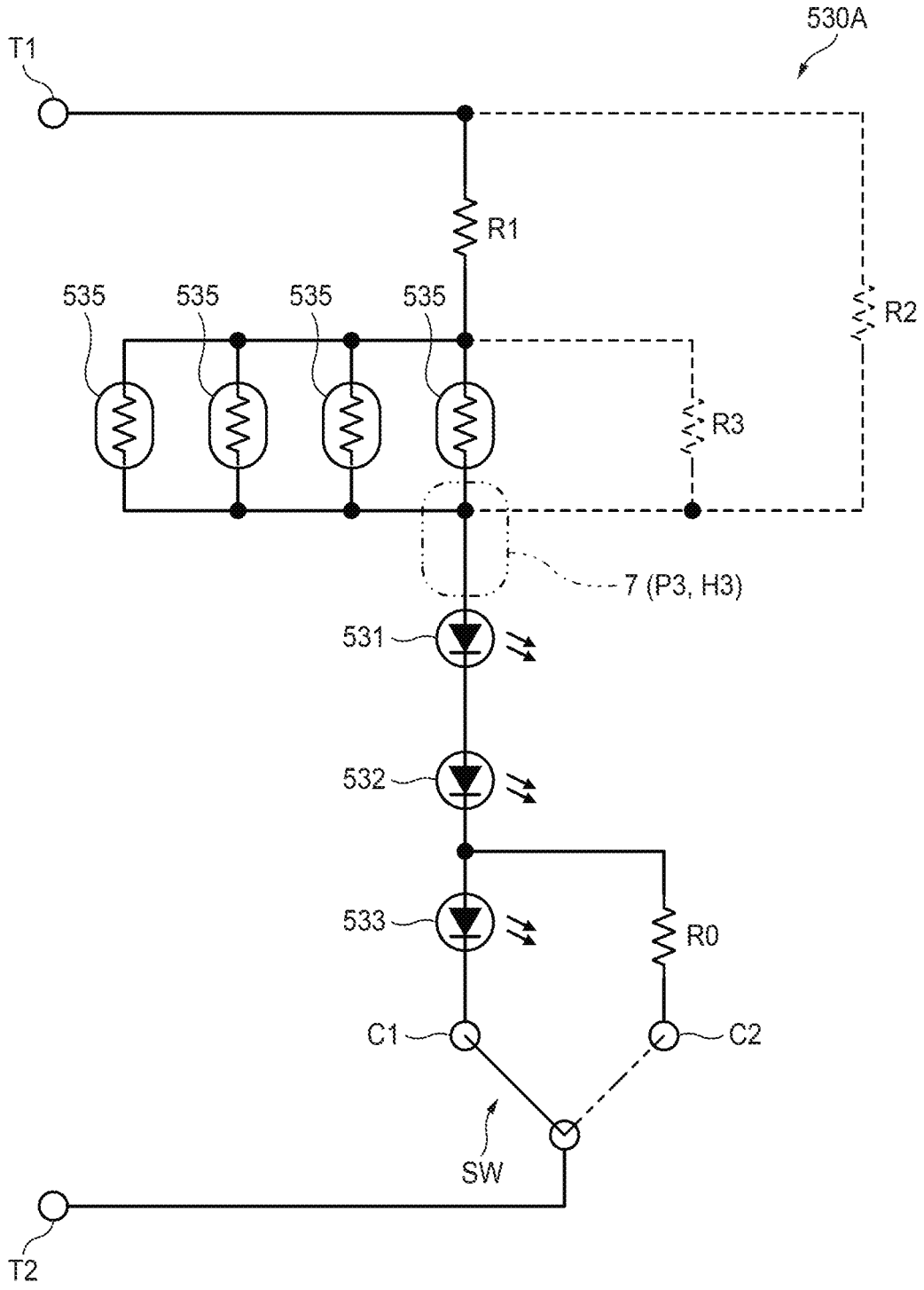
FIG. 8 illustrates a modified example of the light source driving circuit illustrated in FIG. 6.

FIG. 8 illustrates a light source driving circuit 530A according to such a modification. In this example, the first fixed resistor R1, the PTC thermistor 535, and the first light emitting element 531 are connected in series in this order from the voltage source side.

Although not illustrated, in this case, a conductive pattern P3 electrically connecting the first light emitting element 531 and the PTC thermistor 535 is formed on the upper surface 53*a* of the substrate 53. Therefore, the heat conduction suppressor 7 may include a portion in which the width of the conductive pattern P3 is narrowed. The conductive pattern P3 is an example of the first conductive pattern.

Heat generated from the first light emitting element 531 during the operation of the light source driving circuit 530A travels through the conductive pattern P3 toward the PTC thermistor 535. According to the above-described configuration, since the width of a portion of the conductive pattern P3 located on such a heat conduction path is narrowed, heat conduction from the first light emitting element 531 to the PTC thermistor 535 can be suppressed.

In other words, it is possible to suppress an increase in element temperature of the PTC thermistor 535 caused by heat generation of the first light emitting element 531. As a result, the correspondence between the element temperature of the PTC thermistor 535 and the ambient temperature detected by the PTC thermistor 535 can be made close to the intended one. Therefore, the accuracy of the control of the current flowing through the first light emitting element 531, the second light emitting element 532, and the third light emitting element 533 based on the element temperature of the PTC thermistor 535 is improved.

In this example, a simple method of narrowing the width of a portion of the conductive pattern P3 is employed instead of providing a special current control circuit in order to obtain the accuracy of the control. Therefore, an appropriate amount of illumination light can be obtained while suppressing an increase in the product cost of the headlamp device 1.

Additionally or alternatively, a plurality of through holes H3 may be formed in a region of the conductive pattern P3 located in the vicinity of the PTC thermistor 535. The inner peripheral wall of each through hole H3 is covered with a conductive member. Although not illustrated, each through hole H3 electrically connects the conductive pattern P3 formed on the upper surface 53*a* of the substrate 53 and the conductive pattern formed on the lower surface 53*b* of the substrate 53. The heat conduction suppressor 7 may include each through hole H3. The through hole H3 is an example of the first through hole. The upper surface 53*a* is an example of the first principal surface. The lower surface 53*b* is an example of the second principal surface.

Heat generated from the first light emitting element 531 during the operation of the light source driving circuit 530 travels through the conductive pattern P3 toward the PTC thermistor 535. According to the above-described configuration, the heat reaching the vicinity of the PTC thermistor 535 is dissipated to the conductive pattern formed on the lower surface 53*b* of the substrate 53 through the through holes H3. As a result, heat conduction from the first light emitting element 531 to the PTC thermistor 535 can be suppressed. Each through hole H3 also has a function of releasing heat generated from the PTC thermistor 535.

In other words, it is possible to suppress an increase in the element temperature of the PTC thermistor 535. As a result, the correspondence between the element temperature of the PTC thermistor 535 and the ambient temperature detected by the PTC thermistor 535 can be made close to the intended one. Therefore, the accuracy of the control of the current flowing through the first light emitting element 531, the second light emitting element 532, and the third light emitting element 533 based on the element temperature of the PTC thermistor 535 is improved.

In this example, a simple method of forming the through hole H3 in the conductive pattern P3 is employed instead of providing a special current control circuit in order to obtain the accuracy of the control. Therefore, an appropriate amount of illumination light can be obtained while suppressing an increase in the product cost of the headlamp device 1.

As indicated with dashed lines in FIG. 6, the light source driving circuit 530 may include a second fixed resistor R2. The second fixed resistor R2 is connected in parallel to a circuit in which the first fixed resistor R1 and the PTC thermistor 535 are connected in series.

The second fixed resistor R2 has a function of raising the value of the current flowing through the circuit in which the first fixed resistor R1 and the PTC thermistor 535 are connected in series. As a result, even if the resistance value of the PTC thermistor 535 increases due to the temperature rise so that the current flowing through each light emitting element is limited, a relatively high amount of light can be maintained. In other words, this configuration is suitable for increasing the brightness of the light source.

In FIG. 7, a resistance element corresponding to the second fixed resistor R2 is denoted by a reference symbol 534 (R2). In this example, the slit S1 formed between the resistance element 534 (R2) and the PTC thermistor 535*a* can suppress heat conduction from the resistance element 534 (R2) to the PTC thermistor 535*a*.

Similarly, heat conduction from the resistance element 534 (R2) to the PTC thermistor 535*a* can be suppressed by a portion of the conductive pattern P2 which is located between the resistance element 534 (R2) and the PTC thermistor 535*a* and is narrowed in width.

Similarly, heat conduction from the resistance element 534 (R2) to the PTC thermistor 535*a* can be suppressed by the plurality of through holes H2 formed in the conductive pattern P2 in the vicinity of the PTC thermistor 535*a*.

As indicated with dashed lines in FIG. 6, the light source driving circuit 530 may include a third fixed resistor R3. The third fixed resistor R3 is connected in parallel to the PTC thermistor 535.

The third fixed resistor R3 has a function of adjusting the sensitivity (i.e. the temperature at which the current limitation is initiated and the extent of the limitation) of the PTC thermistor 535. As a result, the operation of the light source driving circuit 530 can be adjusted by a simple method of merely adding a fixed resistor having an appropriate value.

In FIG. 7, a resistance element corresponding to the third fixed resistor R3 is denoted by a reference symbol 534 (R3). In this example, the slit S3 formed between the resistance element 534 (R3) and the PTC thermistors 535*c* and 535*d* can suppress heat conduction from the resistance element 534 (R3) to the PTC thermistor 535*a*.

Similarly, heat conduction from the resistance element 534 (R2) to each of the PTC thermistors 535 can be suppressed by a portion of the conductive pattern P1 which is located between the resistance element 534 (R3) and the PTC thermistors 535*b* and 535*c* and is narrowed in width. In addition, the portion of the conductive pattern P2 which is located between the resistance element 534 (R3) and the PTC thermistor 535*d* and is narrowed in width can suppress heat conduction from the resistance element 534 (R2) to each of the PTC thermistors 535.

Similarly, heat conduction from the resistance element 534 (R3) to each PTC thermistor 535 can be suppressed by the plurality of through holes H1 formed in the conductive pattern P1 in the vicinity of each PTC thermistor 535. The plurality of through holes H2 formed in the conductive pattern P2 in the vicinity of the PTC thermistors 535 can suppress heat conduction from the resistance element 534 (R3) to the PTC thermistors 535.

In FIG. 7, a resistance element corresponding to the fixed resistor R0 illustrated in FIG. 6 is denoted by a reference symbol 534 (R0). In this example, the slit S1 formed between the resistance element 534 (R0) and the PTC thermistors 535*a* and 535*b* can suppress heat conduction from the resistance element 534 (R0) to the PTC thermistor 535*a*.

Similarly, heat conduction from the resistance element 534 (R0) to each of the PTC thermistors 535 can be suppressed by a portion of the conductive pattern P1 which is located between the resistance element 534 (R0) and the PTC thermistors 535*a* and 535*b* and is narrowed in width.

Similarly, heat conduction from the resistance element 534 (R0) to each PTC thermistor 535 can be suppressed by the plurality of through holes H1 formed in the conductive pattern P1 in the vicinity of each PTC thermistor 535.

As is clear from the comparison between FIG. 3 and FIG. 4, in the present embodiment, each resistance element 534 and each PTC thermistor 535 are not covered with the first reflector 51.

According to such a configuration, the heat dissipation performance of the resistance element 534 and the PTC thermistor 535 can be improved. As a result, for example, it is possible to suppress the influence of the heat caged in the first reflector 51 on the element temperature of the PTC thermistor 535. Therefore, the accuracy of the control of the current flowing through the first light emitting element 531, the second light emitting element 532, and the third light emitting element 533 based on the element temperature of the PTC thermistor 535 is improved.

As illustrated in FIG. 4, each resistance element 534 is supported by the upper surface 53*a* of the substrate 53.

Also with such a configuration, it is possible to improve the heat dissipation performance of the resistance element 534.

The above embodiments are merely illustrative to facilitate an understanding of the presently disclosed subject matter. The configuration according to each of the above embodiments can be appropriately modified or improved without departing from the gist of the presently disclosed subject matter.

Figure 9:
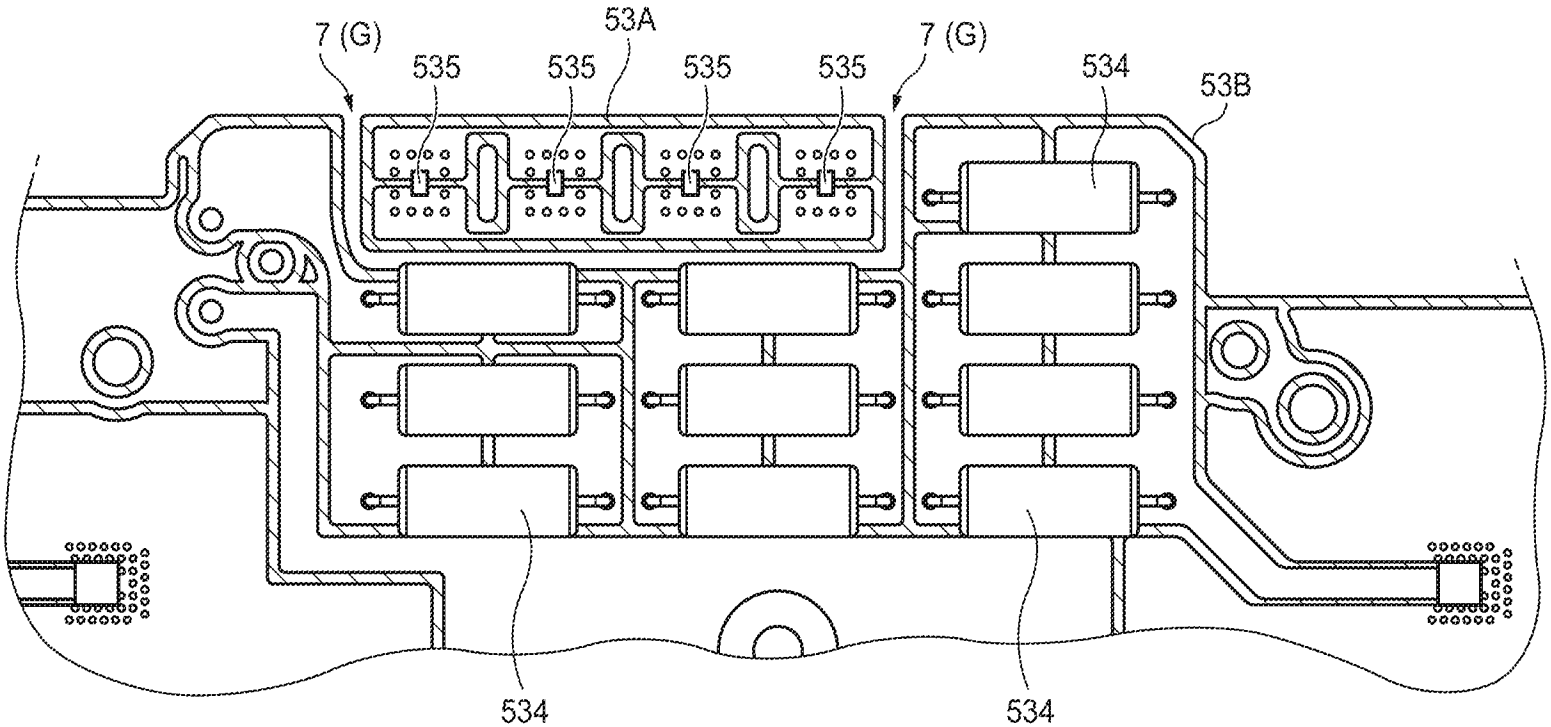
FIG. 9 illustrates a modified example of the substrate illustrated in FIG. 4.

In the above embodiment, the first light emitting element 531, the second light emitting element 532, the third light emitting element 533, the resistance element 534, and the PTC thermistor 535 are supported on a common substrate 53. However, as illustrated in FIG. 9, a configuration in which a first substrate 53A and a second substrate 53B are provided may also be employed.

The first substrate 53A supports a PTC thermistor 535. The second substrate 53B supports the first light emitting element 531, the second light emitting element 532, the third light emitting element 533, and the resistance element 534. In this case, the heat conduction suppressor 7 includes a gap G that separates the first substrate 53A and the second substrate 53B from each other. Appropriate circuit wirings formed between the first substrate 53A and the second substrate 53B are not illustrated.

Heat generated from each light emitting element and each resistance element 534 during the operation of the light source driving circuit travels through the second substrate 53B. According to the above configuration, the gap G prevents such heat conduction to the first substrate 53A.

In other words, it is possible to suppress an increase in element temperature of the PTC thermistor 535 caused by heat generation of each light emitting element or the resistance element 534. As a result, the correspondence between the element temperature of the PTC thermistor 535 and the ambient temperature detected by the PTC thermistor 535 can be made close to the intended one. Therefore, the accuracy of the control of the current flowing through each light emitting element based on the element temperature of the PTC thermistor 535 is improved.

In this example, a simple method of separating two substrates by the gap G is employed instead of providing a special current control circuit in order to obtain the accuracy of the control. Therefore, an appropriate amount of illumination light can be obtained while suppressing an increase in the product cost of the headlamp device 1.

The present application is based on Japanese Patent Application No. 2017-027634 filed on Feb. 17, 2017, the entire contents of which are incorporated herein by reference.

The invention claimed is:

1. A lighting device adapted to be mounted on a vehicle, comprising:

a semiconductor light emitting device, at least one first PTC (positive temperature coefficient) thermistor, and a first fixed resistor that are connected in series with a voltage source;

a first substrate supporting the first PTC thermistor; and a heat conduction suppressor configured to suppress heat conduction from at least one of the semiconductor light emitting device and the first fixed resistor to the first PTC thermistor.

2. The lighting device according to claim 1, wherein the first substrate supports the first fixed resistor; and wherein the heat conduction suppressor includes a first slit formed in the first substrate and on a heat conduction path from at least one of the first fixed resistor and the semiconductor light emitting device to the first PTC thermistor.

3. The lighting device according to claim 1, wherein the first substrate supports the first fixed resistor;

wherein a first conductive pattern electrically connecting at least one of the first fixed resistor, the semiconductor light emitting device, and the first PTC thermistor is formed on the first substrate; and wherein the heat conduction suppressor includes a portion in which a width of the first conductive pattern is narrowed.

4. The lighting device according to claim 1, wherein the first substrate supports the first fixed resistor;

wherein a first conductive pattern electrically connecting at least one of the first fixed resistor, the semiconductor light emitting device, and the first PTC thermistor is formed on a first principal surface of the first substrate; and wherein the heat conduction suppressor includes a first through hole electrically connecting the first conductive pattern and a conductive pattern formed on a second principal surface of the first substrate.

5. The lighting device according to claim 1, comprising:

a first substrate supporting the first PTC thermistor; and a second substrate supporting the semiconductor light emitting device and the first fixed resistor, wherein the heat conduction suppressor includes a gap separating the first substrate and the second substrate.

6. The lighting device according to claim 1, comprising:

a second PTC thermistor supported on the first substrate, wherein the heat conduction suppressor includes a second slit formed on a heat conduction path between the first PTC thermistor and the second PTC thermistor in the first substrate.

7. The lighting device according to claim 1, comprising:

a second PTC thermistor supported on the first substrate, wherein a second conductive pattern connecting the first PTC thermistor and the second PTC thermistor in parallel is formed on the first substrate; and wherein the heat conduction suppressor includes a portion in which a width of the second conductive pattern is narrowed.

8. The lighting device according to claim 1, comprising:

a second PTC thermistor supported on the first substrate, wherein a second conductive pattern connecting the first PTC thermistor and the second PTC thermistor in parallel is formed on the first principal surface of the first substrate; and wherein the heat conduction suppressor includes a second through hole electrically connecting the second conductive pattern and the conductive pattern formed on the second principal surface of the first substrate.

9. The lighting device according to claim 1, comprising:

a second fixed resistor connected in parallel to a circuit in which the first fixed resistor and the first PTC thermistor are connected in series.

10. The lighting device according to claim 1, comprising:

a third fixed resistor connected in parallel to the first PTC thermistor.

11. The lighting device according to claim 1, comprising:

a reflector configured to reflect light emitted from the semiconductor light emitting device, wherein the first fixed resistor and the first PTC thermistor are not covered by the reflector.

12. The lighting device according to claim 1, wherein the first fixed resistor is supported on a surface of the first substrate that is configured to be directed upward.

* * * * *